United States Patent [19]

Wood

[11] 3,971,171

[45] July 27, 1976

[54] DEBRIS CAP MECHANISM FOR A SUBSEA WELLHEAD

[75] Inventor: Norman J. Wood, San Jose, Calif.

[73] Assignee: Subsea Equipment Associates, Hamilton, Bermuda

[22] Filed: July 8, 1975

[21] Appl. No.: 594,012

[52] U.S. Cl. ..... 52/19; 166/.5

[51] Int. Cl.[2] ..... E04D 29/14

[58] Field of Search ..... 166/.5, 93; 52/19–21, 52/66, 69

[56] References Cited

UNITED STATES PATENTS

| | | | |
|---|---|---|---|
| 2,037,114 | 4/1936 | Bonsall | 52/19 |
| 2,799,476 | 7/1957 | Bielstein | 166/93 |
| 3,063,500 | 11/1962 | Logan | 166/.5 |
| 3,093,097 | 6/1963 | Rosenfeld | 52/19 |
| 3,230,844 | 1/1966 | Isaacs | 52/20 |
| 3,247,672 | 4/1966 | Johnson | 166/.5 |
| 3,352,357 | 11/1967 | Van Eek | 166/.5 |
| 3,461,957 | 8/1969 | West | 166/.5 |

*Primary Examiner*—Ernest R. Purser
*Assistant Examiner*—Henry Raduazo
*Attorney, Agent, or Firm*—Ernest F. Marmorek

[57] ABSTRACT

A debris cap mechanism for use in connection with a housing to enclose and protect a re-entry hub of a subsea well features frame means adapted for engaging the housing, first sealing means adapted to be disposed between the frame means and the housing and operative to inhibit the passage of liquid therebetween, lid means movable between closed and opened positions respectively and connected to the frame means in such a manner that clear access to the re-entry hub is possible when the lid means is in its open position, and second sealing means adapted to be disposed between the frame means and the re-entry hub and operative to inhibit the passage of liquid therebetween, the frame means being movable and operative for moving the lid means between its closed and its open positions.

7 Claims, 4 Drawing Figures

DEBRIS CAP MECHANISM FOR A SUBSEA WELLHEAD

BACKGROUND OF THE INVENTION

The invention relates to a debris cap mechanism for use in connection with a housing to enclose and protect a re-entry hub of a subsea well.

The development of subsea oil and gas production equipment particularly for remote controlled operation is a relatively new field and presents new problems not encountered by land based and platform operations. Generally, the subsea equipment must be highly reliable, have a long service life, and have a low pollution hazard.

Generally, the debris cap for the protection of the subsea re-entry hub or wellhead should meet the following requirements. The debris cap should provide a protective cover over the re-entry hub and the housing circumferentially surrounding the well. The debris cap should be preferably flush with the top edge of the housing to prevent debris and other objects from damaging the hub or otherwise interfering with the subsea operations. In practice, the debris cap can be cleared of objects by the use of a water jet.

When the debris cap is in its closed position, there should be a leak type closure with respect to the housing. The debris cap and the housing defines an enclosure in which oil and gas rising from sources below it are accumulated and can be monitored in order to evaluate the pollution hazard.

It is of great importance that the debris cap be removable during the wellhead work over operations in order to join a re-entry connector on a handling tool to the re-entry hub. The removal of the debris cap should be simple and preferably passive. Preferably, actuators on the handling tool should be operable to move the debris cap aside.

Additionally, it is anticipated that there is a possibility that the production equipment might have leaking which will be trapped under the debris cap so that it is preferable to provide a vent for the gas.

In practice, it is expected that the debris cap will be used at depths to 1,000 feet and must be designed to resist corrosion due to sea water, crude oils, and hydrogen sulfide gas. A selection of metals must be made to avoid the formation of galvanic cells.

SUMMARY OF THE INVENTION

One of the principal objects of the invention is a debris cap mechanism for use in connection with a housing to enclose and protect a re-entry hub of a subsea well.

Another object of the invention is a debris cap mechanism for use in connection with a housing to enclose and protect a re-entry hub of a subsea well including frame means adapted for engaging the housing, first sealing means adapted to be disposed between the frame means and the housing and operative to inhibit the passage of liquid therebetween, lid means movable between closed and opened positions respectively, and connected to the frame means in such a manner that clear access to the re-entry hub is possible when the lid means is in its open position, and second sealing means adapted to be disposed between the frame means and the re-entry hub and operative to inhibit the passage of liquid therebetween, the frame means being movable and operative for moving the lid means between its closed and its open positions.

Further objects and advantages of the invention will set forth in part in the following specification and in part will be obvious there from without being specifically referred to, the same being realized and attained as being pointed out in the claims hereof.

The invention accordingly comprises the features of construction, combination of elements and arrangement of parts which will be exemplified in a construction hereinafter set forth and the scope of the application of which will be indicated in the claims.

BRIEF DESCRIPTION OF THE DRAWINGS

For a full understanding of the nature and objects of the invention, reference should be had to the following detailed description, taken in connection with the accompanying drawings, in which.

DESCRIPTION OF THE PREFERRED EMBODIMENT

Figure 1:
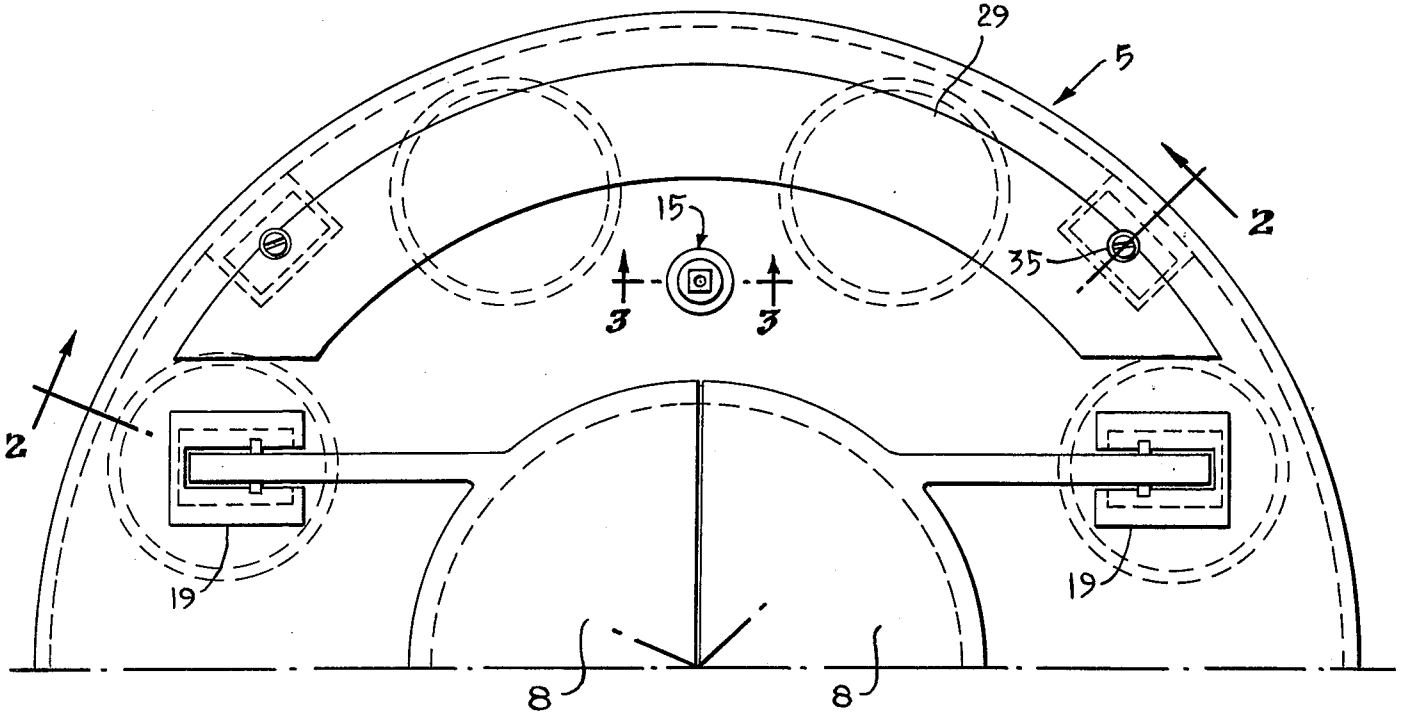
FIG. 1 is a partial plan view of the invention.
Figure 2:
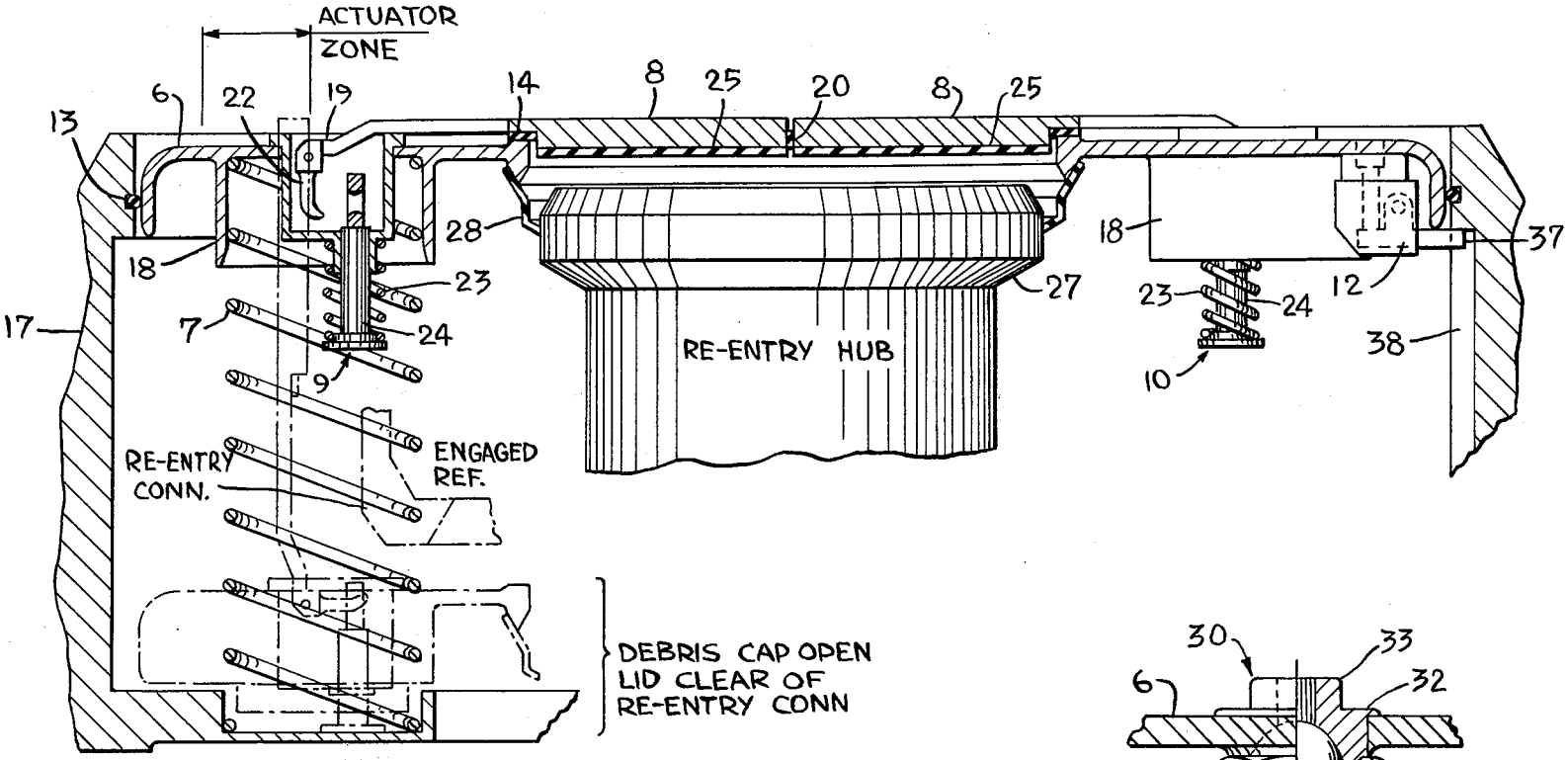
FIG. 2 is a sectional view of FIG. 1 along the line 2—2.
Figure 3:
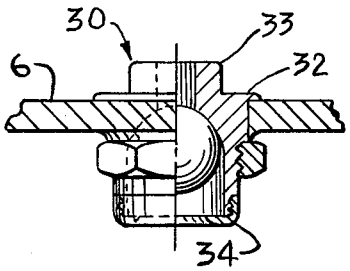
FIG. 3 is a partial sectional view of FIG. 1 along the line 3—3.

In carrying the invention into effect, one of the embodiments has been selected for illustration in FIGS. 1 to 4 and for description in the specification.

In the preferred embodiment shown in FIGS. 1 to 4, the invention is symmetrical in the plan view although it need not be symmetrical in general.

Generally, the debris cap 5 includes frame means such as annular plate 6, eight coil springs 7, lid means such as two hinged semi-circular lids 8, four plunger mechanisms 9 and 10, four latches 12, two sealing means such as seals 13 and 14 and two gas vent valves 15.

The annular plate 6 is supported by the springs 7 within the housing 17. The tops of the springs 7 are disposed and supported within cups 18 on the under side of the annular plate 6. The bottom ends of the springs 7 are seated in machined pockets defined in the housing 17. The annular plate 6 contacts the housing at the seal 13. The annular plate 6 is restrained from over-travel when closed by the four latches 12 which also act as guides for the annular plate 6 when it is depressed to move the lids 8 to their opening position.

The lids 8 are rotatably attached at hinge means 19 and are sealed with respect to each other by seal 20. The seal 14 is disposed between the lids 8 and the plate 6 near the circumference of the lids 8.

A toe 22 on each hinge 19 actuates the plunger mechanisms 9 and 10. Each plunger mechanism 9 and 10 includes a spring 23 and plunger rod 24. A rub strip 25 is connected to the bottom surface of the lids 8 in order to protect the surface of the re-entry hub 27. A seal 28 is provided between the plate 6 and the re-entry hub 27.

The lids 8 are moved to the open positon by the application of forces in the actuator zones 29 by the handling tool (not shown) which will enter the hub 27 for the operations. The force applied to the actuator zones 29 pushes the debris cap 5 down into the space defined between the housing 17 and the hub 27. The forces applied to the actuator zones 29 are approximately 180° apart and are disposed so they do not interfere with the movement of the lids 8 into the open position.

Figure 4:
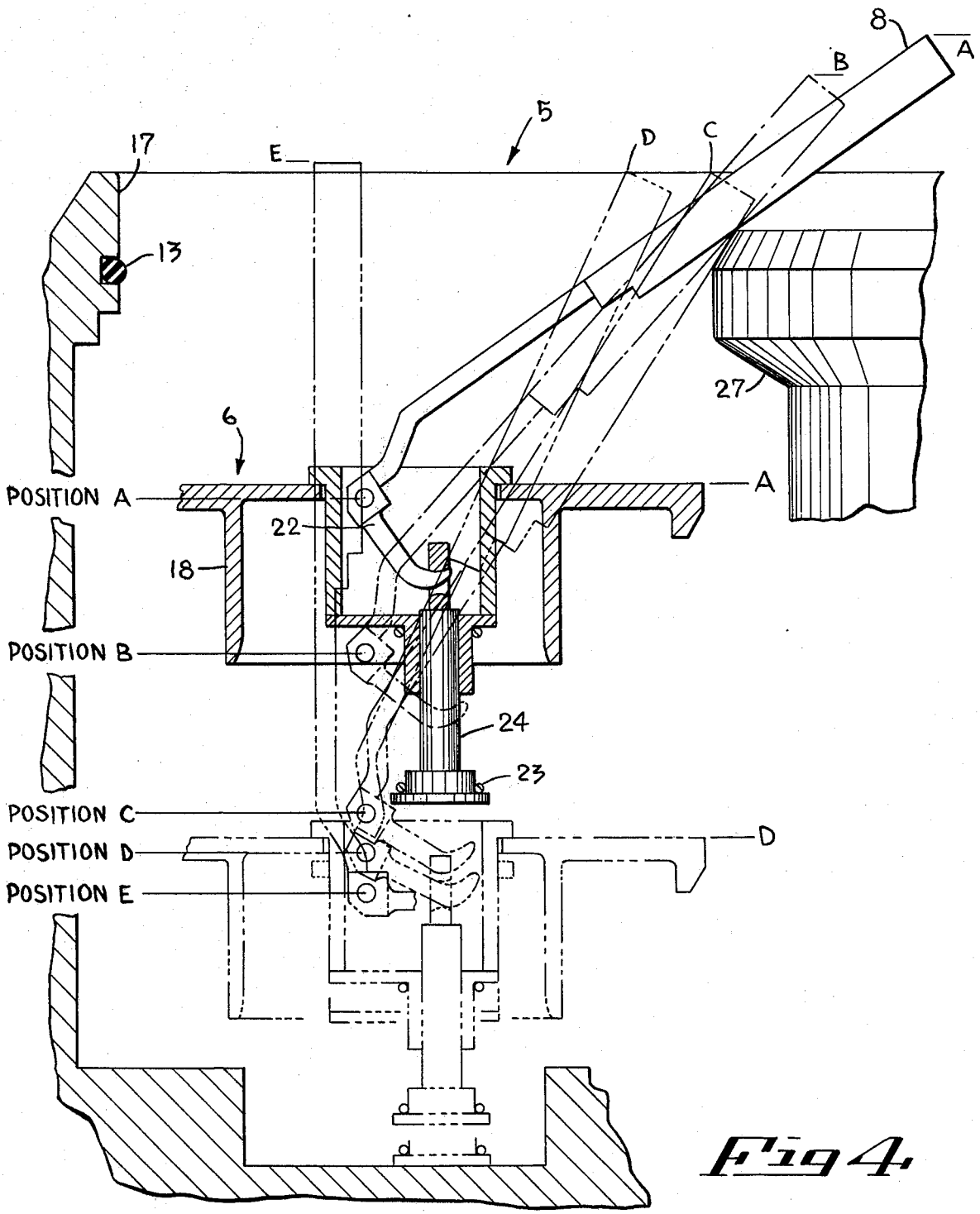
FIG. 4 is a partial sectional view of the invention in successive positions.

FIG. 4 shows the debris cap 5 in different positions during the opening operation. As the annular plate 6 is lowered, the bottom face of the hinges 8 contacts the top of the hub 27 at the rub strips 25 and the lids 8 begin to cam open as the lids 8 rotate about the lowering hinge point.

After the lids 8 have moved a short distance, the toe 22 engages a hole at the top end of the plunger 24 and thereafter the movement of the lids 8 results in the plunger 24 to be retracted while spring 23 is compressed. Eventually, the base of the plunger 24 contacts the base of the well at which point the lids 8 have nearly completed their entire camming rotation. The continued downward motion on the actuator zones 29 eventually results in the plungers 24 to become fully retracted and the hinged lid toe 22 assumes a horizontal position and the lids 8 are fully vertical. Additional vertical force moves the lids 8 away from the hub 27 into the compartment defined between the well and the housing 17. The plunger 24 is designed so that the lids 8 are fully open when the plate 6 is at the bottom of its travel.

The debris cap 5 can be moved to its opened position even with a single failure of one of the eight springs 7 or if the plate 6 is depressed at some angle due to a failure in the actuators applied to the actuator zones 9.

Two ball float gas vent valves 30 are used even though one would be adequate. The intent is to increase the reliability of the venting system. The vent valves 30 are of standard design and each includes a ball float 32 in a chamber 33 and a retainer wire 34. The ball float 32 is supported by hydrostatic forces arising from the liquid surrounding it. When gas accumulates in the cavity defined in the debris cap 5, the ball float 32 follows the lowering fluid level and thereby opens the valve 30 to allow gas to escape. When the fluid level, oil or water, rises again, the ball float 32 eventually closes the valve 30 again. The wire retainer 34 maintains the ball float 32 in place.

Although there are four latches 12, only three of them are needed for satisfactory operation. The latches 12 are operable from the top surface of the plate 6 but remain flush. The locking screw 35 is countersunk into the face of the plate 6. The toe 37 of the latch 12 serves a dual function, besides its locking function it also guides the movement of the plate 6 within the housing 17 between rails 38 to prevent the debris cap 5 from rotating.

The lip seal 28 between the plate 6 and the hub 27 permits the accumulation of a relative stagnant fluid volume over the hub 27. In practice, an anti-foulant toxicant material is disposed on the lower face of the lids 8 to provide anti-fouling protection to the hub 27. The seal 28 is provided with several small holes therethrough to allow pressure equalization so that the lids 8 will open and close freely.

The design of the debris cap 5 provides fail-safe features. If during the process of opening the debris cap 5 the handling tool is removed, the plunger mechanisms 9 and 10 will close the debris cap 5 automatically for most positions of the lids 8. When the debris cap 5 is closed, it provides a leak tight shield across the top of the housing 17. The plate 6 is sealed to the housing 17 along its periphery by the seal 13 and to the lids 8 by seals 14. The lids 8 are sealed at their joint by the seals 20. The seals 20 are engaged or effective when the plate 6 is fully raised.

I wish it to be understood that I do not desire to be limited to exact details of construction shown and described, for obvious modifications will occur to a person skilled in the art.

Having thus described the invention, what I claim as new and desire to be secured by Letters Patent, is as follows:

1. A debris cap mechanism, for use in connection with a housing to enclose and protect a re-entry hub of a subsea well, comprising, in combination:

frame means adapted for engaging said housing;

first sealing means adapted to be disposed between said frame means and said housing and operative to inhibit the passage of liquid therebetween;

lid means movable between closed and opened positions, respectively, and connected to said frame means in such a manner that clear access to said re-entry hub is possible when said lid means is in its open position;

second sealing means adapted to be disposed between said frame means and said re-entry hub and operative to inhibit the passage of liquid therebetween, said frame means being movable and operative for moving said lid means between its closed and open positions.

2. The debris cap mechanism as claimed in claim 1, further comprising at least one gas vent valve means disposed in said frame means and operative to vent accumulated gas.

3. The debris cap mechanism as claimed in claim 1, wherein there is a compartment defined between said well and said housing and said frame means is operative to be moved into said compartment.

4. The debris cap mechanism as claimed in claim 3, further comprising a plurality of latch means disposed in said frame means and operative for latching said frame means to said housing.

5. The debris cap mechanism as claimed in claim 4, wherein each of said latch means includes a portion extending towards said housing and said housing includes guide means operative to engage said portions of said latch means and guide them, whereby said debris cap mechanism is inhibited against rotation during the opening of said lid means.

6. The debris cap mechanism as claimed in claim 1, further comprising a plurality of plunger mechanisms connected to said frame means and operative to oppose the opening of said lid means throughout most of its positions and to maintain said lid means in its open position when it has nearly obtained its full open position.

7. The debris cap mechanism as claimed in claim 1, wherein said lid means are operative to cam open by contacting said hubs of said well during the downward movement of said frame means.

* * * * *